US008109261B2

(12) United States Patent
Grace, Jr.

(10) Patent No.: US 8,109,261 B2
(45) Date of Patent: Feb. 7, 2012

(54) ARCHERY STRING NOCK

(75) Inventor: Louis Grace, Jr., North Street, MI (US)

(73) Assignee: Grace Engineering Corp., Memphis, MI (US)

( * ) Notice: Subject to any disclaimer, the term of this patent is extended or adjusted under 35 U.S.C. 154(b) by 158 days.

(21) Appl. No.: 12/637,255

(22) Filed: Dec. 14, 2009

(65) Prior Publication Data

US 2010/0154769 A1 Jun. 24, 2010

Related U.S. Application Data

(60) Provisional application No. 61/139,379, filed on Dec. 19, 2008.

(51) Int. Cl.
*F41B 5/00* (2006.01)

(52) U.S. Cl. ..... 124/91

(58) Field of Classification Search ..... 124/90, 124/91, 92; 446/255
See application file for complete search history.

(56) References Cited

U.S. PATENT DOCUMENTS

| | | | | | |
|---|---|---|---|---|---|
| 116,773 | A | * | 7/1871 | Sumner | 446/255 |
| 822,628 | A | * | 6/1906 | Philippart | 446/255 |
| 2,777,437 | A | * | 1/1957 | Allen | 124/91 |
| 4,194,316 | A | * | 3/1980 | Jordon | 446/255 |
| 5,016,603 | A | * | 5/1991 | Tentler | 124/91 |
| 5,390,657 | A | | 2/1995 | Larson | |
| 5,715,805 | A | | 2/1998 | Summers et al. | |
| 6,162,110 | A | * | 12/2000 | Szumowski | 446/255 |

OTHER PUBLICATIONS

T.R.U. Spyder Silencers, downloaded from http://www.cabelas.com/cabelas/en/templates/pod/standard-pod-wrapped.jsp?id=0004495&navCount=1&parentId=cat20078&masterpathid=&navAction=push&cmCat=MainCatcat21424-cat20078&parentType=index&indexId=cat20078&rid= on Dec. 8, 2009.

Bowjax Slipjax Dampeners, downloaded from http://www.bowjax.com/slipjax.html on Dec. 8, 2009.

Bowjax Ultrajax Dampeners, downloaded from http://www.bowjax.com/ultrajax2.html on Dec. 8, 2009.

Sims Limbsaver Super String Leech, downloaded from http://www.cabelas.com/cabelas/en/templates/product/standard-item.jsp?id=0056977418575a&navCount=1&podId=0056977&parentId=cat20078&masterpathid=&navAction=jump&cmCat=MainCatcat21424-cat20078&catalogCode=QZ&rid=&parentType=index&indexId=cat20078&hasJS=true on Dec. 8, 2009.

* cited by examiner

*Primary Examiner* — John Ricci
(74) *Attorney, Agent, or Firm* — Warner Norcross & Judd LLP

(57) ABSTRACT

A speed nock for use with an archery bow includes a first enlarged portion and a second enlarged portion connected via a central portion. The central portion has a maximum dimension smaller than maximum dimensions of the first and second enlarged portions. The central portion is positioned between strands of a bowstring of the bow so that the strands pinch the central portion, at least assisting in holding the speed nock in place along the bowstring. The speed nock can be moved along the bowstring to a selected location that maximizes energy imparted to an arrow shot from the archery bow, and thus the speed of the arrow. A related method of using the speed nock above is also provided.

20 Claims, 4 Drawing Sheets

ARCHERY STRING NOCK

This application claims the benefit of U.S. Provisional Application 61/139,379 filed Dec. 19, 2008 which is hereby incorporated by reference.

BACKGROUND OF THE INVENTION

The present invention relates to archery bows, and more particularly to bowstring weights commonly identified as string nocks or speed nocks.

Conventional archery bows, and in particular compound archery bows, include a bowstring and a set of cables that transfer energy from the limbs and cams or pulleys of the bow to the bowstring, and thus to an arrow shot from the bow. To reduce vibration, and to further increase the energy imparted to the arrow by the bow, optional weights, such as string nocks or speed nocks (both referred to as speed nocks herein) are strategically positioned on the bowstring, typically at one or more vibration nodes along the bowstring.

Typically, the speed nocks are placed on either or both of the upper and lower portions of the bowstring, near to the cams on a double cam bow, or near the cam and near the pulley on a single cam bow. The size of the speed nock and its location on the bowstring typically increase the energy imparted to the arrow by the bow, and accordingly increase arrow speed. The weight and location of speed nocks are usually unique to the type of bow and related equipment, such as arrows or accessories attached to the bow, and normally differ for the upper and/or lower portions of the bowstring as well. Any changes made to the equipment may require modification in the location of the speed nocks and possibly the weight and or size of the speed nocks. Usually, the optimum weights and locations are achieved by trial and error testing, in which an arrow is shot through a speed-measuring chronograph repeatedly. The placement and/or weights of the speed nocks are adjusted until the fastest arrow speed is identified.

Conventional speed nocks are split metal "U" shaped devices, usually having a brass outer portion and an inner portion that is a softer material that engages a serving of the bowstring or the bowstring itself. The "U" shaped device is placed around the bowstring, and the "U" is crimped so that it fully encircles the bowstring, and is held in a specific location.

Achieving the desired location, as noted above, is an iterative process with the "U" shaped speed nocks. This process includes initially crimping at least one speed nock to each end of the bowstring near the cams, and shooting multiple arrows, while measuring the arrow speed of each shot with a chronograph. The nocks are un-crimped, moved incrementally along the bowstring, and then re-crimped. The arrows subsequently are shot again and the arrow speed is measured. These steps are repeated until the "sweet spot" is located where the arrow speed peaks. If additional nocks are desired, the process starts anew.

For safety reasons, many archers secure the "U" shaped nocks by heat shrinking tubing over the nocks to prevent them from, possibly disengaging the string and causing injury. Application of the heat shrink tubing usually requires unstringing and restringing the bow after the "sweet spots" are determined.

The inner portion of most "U" shaped speed nocks is an elastomer that, as mentioned above, engages the bowstring or serving, and alleviates damage to the bowstring. While the elastomer reduces some wear on the string, where multiple crimping and uncrimping steps in the trial and error process are performed, the elastomer or metal part can wear on the individual fibers of the strands of the bowstring, prematurely shortening the life of the bowstring.

There are other speed nocks in the market that have a different structure. For example, another speed nock, commercially available from T.R.U. Ball® under the Speed Nok name, includes aluminum parts that define grooves adapted to receive the bowstring. The parts are secured around the bowstring by clamping them together with integral screws. The bowstring remains trapped within the parts.

Another example of a speed nock is a segment of rubber or similar elastomeric tubing material that encircles the bowstring. The tubing can be in the form either of individual segments or as segments that are defined by partial cuts in the tubing. In either form, the number of segments needed are estimated and then threaded on the bowstring before stringing the bow. The segments are moved up or down the exterior of the bowstring until the optimum locations are determined. If the estimated number of segments is inadequate, the bow must be un-strung. Additional segments must be threaded on the bowstring, and the bow re-strung. The segments remain in place at the selected locations by the gripping properties of the elastomeric material.

Although the above conventional bowstring speed nocks may achieve the desired objective, there remains room for improvement.

SUMMARY OF INVENTION

A speed nock for a bowstring of an archery bow is provided. The speed nock is readily adjustable to an optimum location to achieve maximum arrow speed. Optionally, the speed nock can be secured without completely removing the bowstring from the archery bow.

In one embodiment, the speed nock includes a first enlarged portion and a second enlarged portion connected via a central portion. The central portion has a maximum dimension smaller than maximum dimensions of the first and second enlarged portions. The central portion is positioned between strands of a bowstring so that the strands pinch the central portion, at least assisting in holding the speed nock in place along the bowstring.

In another embodiment, the speed nock is geometrically configured to allow ease of insertion and movement, for example sliding, between the strands of the bowstring. The dimensions and/or configuration can be readily altered in manufacturing to provide different weights.

In yet another embodiment, the speed nock can be in the form of a three dimensional exercise dumbbell or hourglass. Optionally, greater mass can be symmetrically distributed at the enlarged portions and opposing ends.

In still another embodiment, the first and second enlarged portions are adapted to be positioned adjacent the bowstring, with the central portion of the speed nock passing at least partially through the bowstring, trapped in place by strands on opposite sides of the central portion.

In a further embodiment, the speed nock can be constructed from a variety of materials such as metal, composites or polymers.

In yet a further embodiment, the central portion of the speed nock can be coated, polished or micro-finished so that it has a smooth surface that engages the strands of the bowstring without significantly abrading them. Due to the smoothness, the speed nock optionally can be more easily slid along the bowstring, between the strands, for adjustment, without significantly abrading the strands.

In another, further embodiment, a method is provided for increasing the speed of an arrow, shot from an archery bow, with the speed nock. An enlarged portion of the speed nock is inserted through the bowstring, between strands of the string, optionally without un-stringing the bowstring from the bow. Insertion is continued until the central portion is between the strands. The strands pinch the central portion and hold the speed nock in place. Optionally, the bow can be repeatedly shot, and the speed nock moved along the bowstring until a desired speed is achieved.

The bowstring speed nock provided herein can be inexpensively manufactured and easily adjusted. The speed nock can function in an efficient and reliable manner, can be easily installed, adjusted, and secured relative to the bowstring without significant potential for damage to the bowstring, and without un-stringing and re-stringing the archery bow if desired.

DETAILED DESCRIPTION OF THE CURRENT EMBODIMENT

I. Overview

Figure 1:
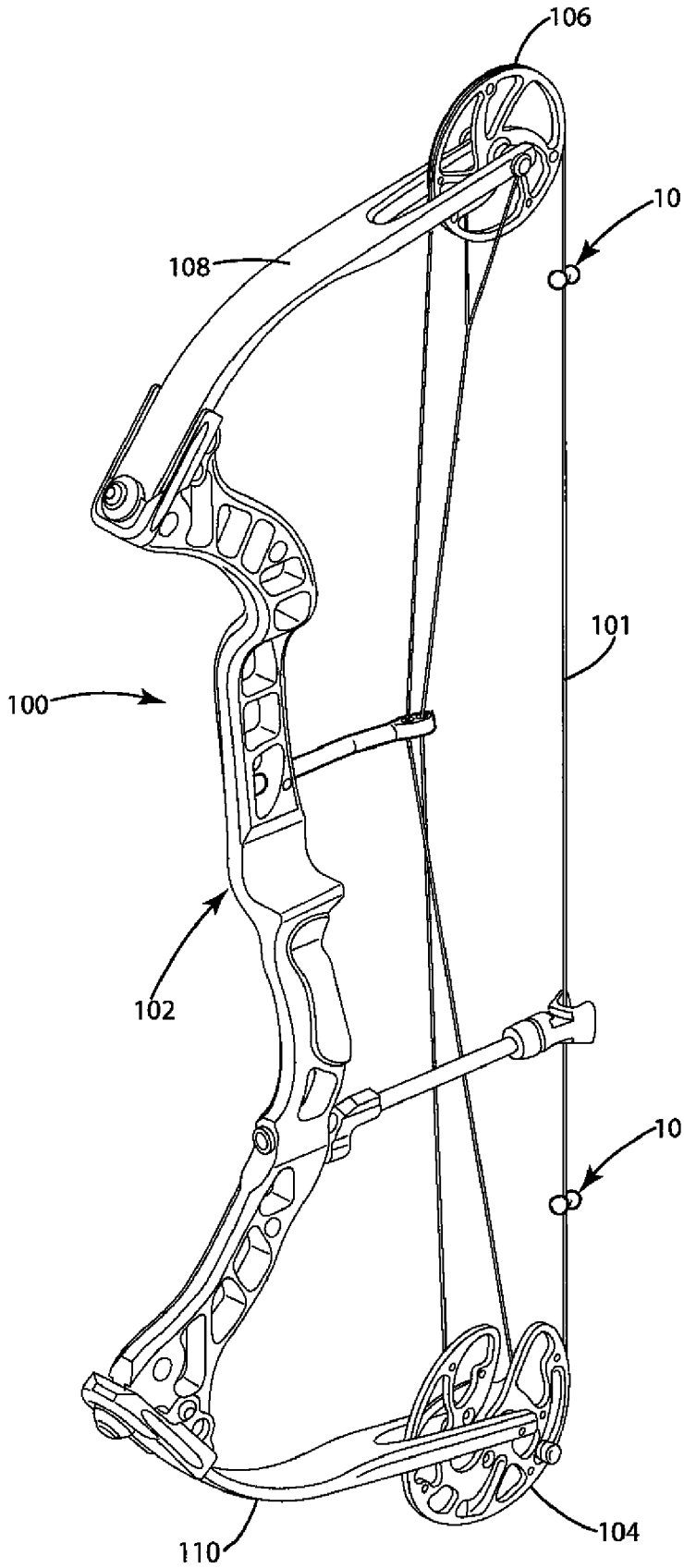
FIG. 1 is a perspective view of an archery bow having speed nocks of a current embodiment installed on its bowstring.
Figure 2:
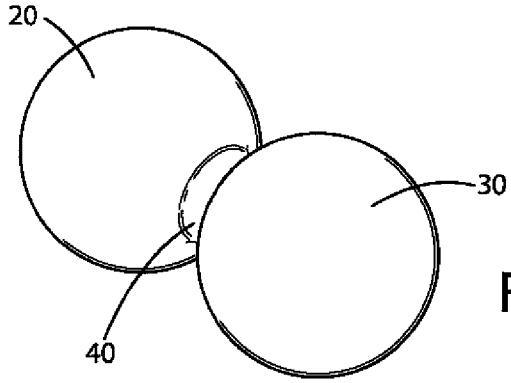
FIG. 2 is a perspective view of the speed nock.
Figure 4:
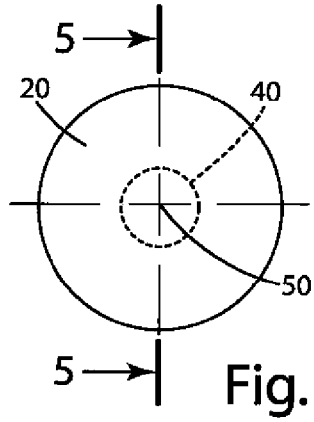
FIG. 4 is an end view of the speed nock.
Figure 5:
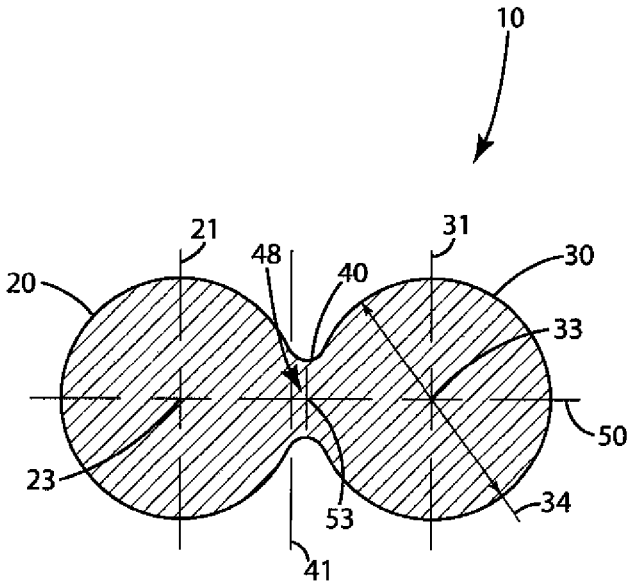
FIG. 5 is a cross section view of the speed nock taken along line 5-5 in FIG. 4.
Figure 6:
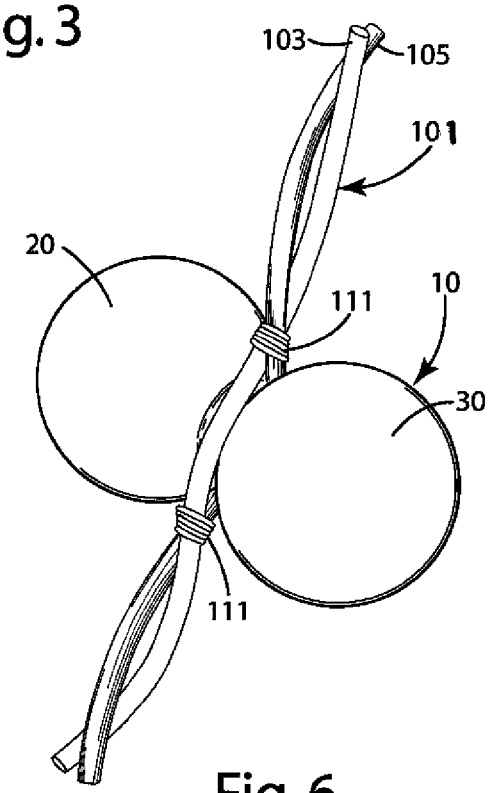
FIG. 6 is a close up view of the speed nock installed on the bowstring.
Figure 7:
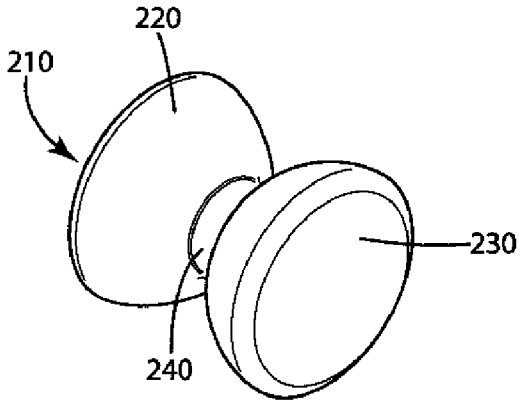
FIG. 7 is a perspective view of a speed nock of a first alternative embodiment.
Figure 8:
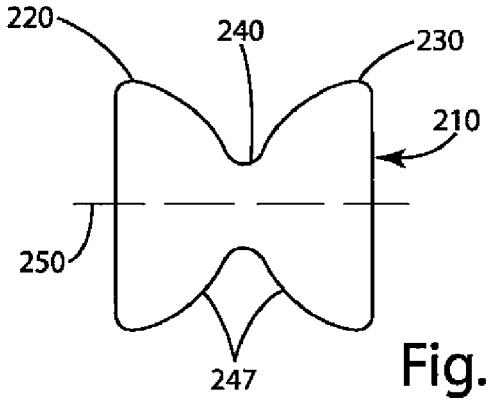
FIG. 8 is a side view of the speed nock of the first alternative embodiment.
Figure 9:
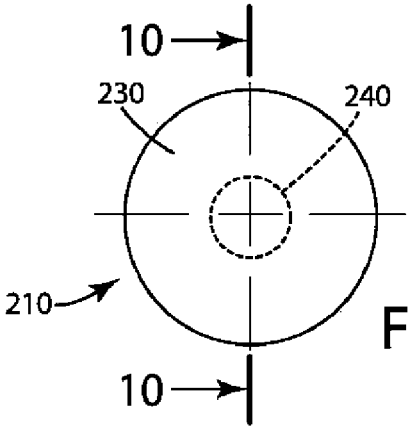
FIG. 9 is an end view of the speed nock of the first alternative embodiment.

A current embodiment of the speed nock is generally shown in FIGS. 1-5 and generally designated by the reference numeral 10. FIG. 1 illustrates two speed nocks 10 positioned on a bowstring 101 of an archery bow 100. As shown in FIG. 2, the speed nock 10 includes a first enlarged portion 20 and a second enlarged portion 30 connected via a central portion 40. The central portion 40 can have a maximum dimension and/or cross section that is less than or smaller than maximum dimensions and/or cross sections of the first and second enlarged portions when the cross sections are taken perpendicular to the longitudinal axis 50 of the speed nock. With reference to FIG. 6, the central portion 40 is positioned between strands, which can be individual strands or groups of strands, 103,105 of the bowstring. Because the bowstring is taut, the strands 103, 105 pinch, clamp or otherwise grab the central portion 40, assisting or fully holding the speed nock in place along the bowstring.

One, two, or more speed nocks 10 can be placed at specific locations on the bowstring 101 between the upper and lower limbs 108, 110, which are generally attached to the riser 102 of the bow. The locations can be at or near the cams 104, and/or pulleys 106 of the bow, generally 1", 2", 3", 4" 5" or other incremental distances from the cams as determined by shooting arrows from the bow and identifying the optimum location for positioning the speed nock(s), as described below.

Although shown installed on a single cam compound archery bow, the embodiments of the speed nocks herein are well suited for dual cam systems, cam and a half systems, and other systems including a bowstring and a cable. Further, although illustrated as a compound bow, the embodiments herein can be used in connection with a cross bow, or any bow including a bowstring and a cable. In addition, although referred to as "cams", that term can include cams, pulleys, wheels, or other mechanical structures that impart a mechanical advantage to energy stored in a bow.

II. Construction

The construction and components of the speed nock 10 will now be described. The speed nock 10 includes first enlarged portion 20, second enlarged portion 30, central portion 40 and a longitudinal axis 50. The longitudinal axis 50 can include a first end 52, a second end 54 opposite the first end, and a central region 56 located between the first and the second end. The precise sizes, dimensions, lengths and cross sections of the ends and central region can vary as desired.

The dimensions and/or cross section of the speed nock 10 can vary along the longitudinal axis 50, and from portion to portion. For illustrative purposes, the dimensions can be measured perpendicular to the longitudinal axis, and the cross sections can be taken along the longitudinal axis, perpendicular to that axis. As shown in FIG. 5, the central portion 40 can have a maximum cross section taken, for example, at location 41 that is less than or smaller than maximum cross sections of the first and second enlarged portions, taken at locations 21 and 31. The maximum cross sections of the enlarged portions can be the same or different as desired.

Similarly, as shown in FIG. 5, the central portion can have a maximum dimension taken, for example, at location 41, that is less than a smaller than maximum dimensions of the first and second enlarged portions, taken at locations 21 and 31. The maximum dimensions of the enlarged portions can be the same or different as desired.

Figure 3:
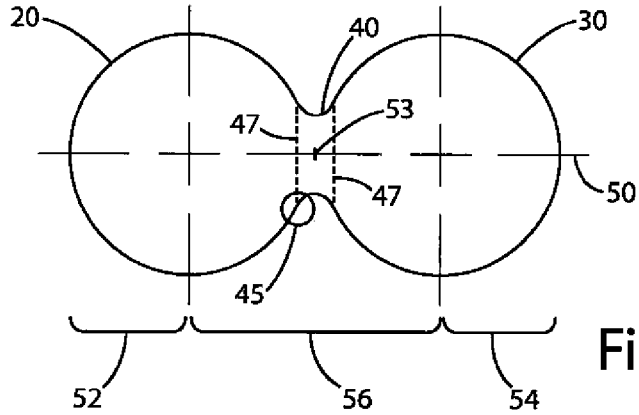
FIG. 3 is a side view of the speed nock.

As shown in FIGS. 2-4, the second enlarged portion 30 and the first enlarged portion 20 can be generally symmetric in shape to one another about the central point 53 of the longitudinal axis. These enlarged portions can also be of approximately the same mass so that the speed nock is balanced about the central point 53 of the longitudinal axis (FIG. 3). Of course, if it is desired to make the speed nock unbalanced, the enlarged portions can vary in size, shape and/or mass.

In the current embodiment, the enlarged first and second portions 20, 30 are in the form of spherical elements aligned with the longitudinal axis 50. The spherical elements generally are located at the ends 52, 54 of the longitudinal axis 50. The longitudinal axis 50 can be oriented so that it passes approximately through centers 23, 33 of the at least partially spherical elements (FIG. 5). Although shown as spherical elements, the enlarged portions can take on a variety of other shapes. Other exemplary shapes include but are not limited to cylinders, joined truncated frustoconical sections, spheroids, truncated spheroids, three dimensional ellipsoids, bulbous shapes or any other geometric shapes. Optionally, the geometric shape can be determined by the shape of the bar stock selected to produce the speed nock.

When in the form of generally spherical elements, the enlarged portions 20, 30 can include portions that transition to the central portion 40 that do not form part of a true sphere, but rather curve away from the surfaces of the spheres to connect with the central portion 40. Further, portions of the surface of the sphere can be flattened, slightly bumpy, or generally non-spherical if desired, or as a result of forming the speed nock.

As shown in FIGS. 2-4, the greater mass of the speed nock 10 is located proximate its extremities or in the enlarged portions 20, 30. Generally, the speed nock can be in the three dimensional form of a dumbbell or hourglass, or any other geometric configuration including a centrally located, reduced cross section suitable for insertion and retention between strands of a bowstring.

The weight of the nock can vary by altering the dimensions of the enlarged portions 20, 30 for example, by altering the diameter 34 (FIG. 5) of the spherical elements, or some other desired dimension of the respective enlarged portions, whatever their geometric configuration. In general, the speed nock 10 can be configured in a variety of weights, for example, 5, 10, 20, 30, 40, 50, 60 or 70 grains, or any other increment between any of these weights. Moreover, multiple speed nocks can be used together, so that the additive cumulative weight of the speed nocks can be virtually any weight desired.

The speed nock 10 can include a central portion 40, which again can extend along the longitudinal axis 50. The central portion can also connect both enlarged portions. In general, the central portion can transition smoothly to the respective first and second enlarged portions. This transition 45 (FIG. 3) can be curvilinear, and generally void of any sharp corners or edges that might abrade the bowstring to which the speed nock is joined. Alternatively, the transition can be abrupt, for example where the central portion 40 is a cylinder that intersects an outer surface of a spherical enlarged portion 20, 30.

The central portion 40 can generally be considered the reduced dimension portion of the speed nock. It includes dimensions and a cross section taken perpendicular to the longitudinal axis 50 that are reduced or less than the dimensions and/or cross sections of the enlarged portions also taken perpendicular to the longitudinal axis.

The central portion 40 can include a finish that can be polished or coated with a smooth coating, or otherwise treated or micro-finished. These surface treatments to the central portion can reduce and/or prevent abrasion of the bowstring strands while inserting and subsequently sliding the speed nock between the strands to its optimum location on the bowstring. The surface treatment can extend generally to the locations 47, which generally correspond to the outermost regions where the strands of a bowstring might contact the speed nock 10 after it is installed in the bowstring.

As best seen in FIG. 5, the central portion 40 can be a smooth "U" shaped section transitioning tangentially from the enlarged portions 20, 30 to its minimum dimension (as shown, a diameter) 48 that passes through the center point 53 of the speed nock 10. The central portion 40, as well as the enlarged portions 20, 30 can be symmetric about the longitudinal axis 50, and further optionally, symmetric about the center point 53.

The speed nock 10 of the current embodiment, and any other embodiment herein, can be produced from a cylindrical rod of rigid material, for example a metal such as steel. Of course, other metals, such as brass, titanium, aluminum, magnesium and the like, as well as ceramics, elastomeric or composite materials may be used as well. The cross section of the rod may be of a variety of geometric shapes including circular, triangular, rectangular, hexagonal, octagonal and other shapes as desired.

The string nock can be precision machined from metal, such as steel, however, again a variety of metals can be used. Optionally, the material selected can have a high weight to volume ratio, in other words, it can be extremely dense. Further optionally, the string nock can be painted or similarly coated to resist corrosion or add aesthetic appeal.

When the speed nock is to be constructed from metal, it can be manufactured via precision machining, such as CNC machining, from bar stock or other suitable stock. This method of manufacture can achieve precise weight control to satisfy the requirements for various bow configurations. In addition, it can readily produce a micro-finish that permits the speed nock to be moved between the strands of the bowstring, for example, by sliding between those strands along the length of a strung bowstring, with minimal to no abrasion of the strands caused by such movement. Alternatively, the string nock may be precision molded from a composite or polymeric material.

FIG. 6 shows the current embodiment speed nock 10 inserted between the strands or groups of strands or fibers 103 and 105 of the bowstring 101. From this illustration, the manner in which speed nock 10 may be easily slid up or down the bowstring 101 to achieve a desired location is readily discernable. Generally, the speed nock 10 twists in a helical motion while tracking along the grouped strands of the bowstring. After a desired location is identified, a user can attach servings 111 above and/or below the speed nock 10, around the bowstring, to anchor the nock in that location on the bowstring, and promote the safety of the archer.

One or more speed nocks can be applied to a bowstring as desired and as shown in FIG. 1. Further, nocks of different weights or nocks of the same weight can be applied at upper and lower ends of the bowstring. For example, a larger and heavier nock can be attached to the end of the bowstring 101 proximate the cam 104, and a smaller and lighter nock can be attached to the bowstring proximate the pulley 106. Of course, the same size and type of nocks can be used on both ends as desired as well. When single weights are utilized on both ends of the bowstring, the "sweet spots" of the bowstring can be determined more readily.

As shown in FIG. 6, an enlarged portion 20 of the speed nock can be inserted through adjacent strands 103, 105 of the bowstring 101. The insertion continues until a smaller portion of the speed nock, that is the central portion 40 is located between the adjacent but separated strands or groups of strands 103, 105. Insertion at that point can be discontinued so that the central portion, for example, the bar joining opposite sides of a generally dumbbell shape, rests between the strands 103, 105 with the speed nock generally trapped in the location on the bowstring. In general, the strands 103, 105 pinch the central portion 40 of the speed nock to at least assist in holding the speed nock 10 in a selected location along the bowstring 101.

With the one or more speed nocks initially positioned at one or more locations on the bowstring, a user shoots arrows from the bow multiple times, and measures the speed of the arrows with a chronograph or other device. The user iteratively slides the speed nock up or down, along the bowstring, until a maximum speed of the arrows is identified. When the maximum speed is identified, the locations of the speed nocks are considered optimal. At that point, inadvertent movement of the speed nock is prevented by serving the speed nock to the bowstring with servings 111. The serving can be located above and/or below the speed nock as desired.

The speed nocks can be slid up or down, between the strands 103, 105 along the axis of the bowstring, until the desired location(s) are achieved, without removing the speed nock from the bowstring, or generally without un-stringing and re-stringing the bowstring from the bow. This can save significant time, and make it easier to maximize speed of the arrows shot from the bow.

III. Alternative Embodiments

Figure 10:
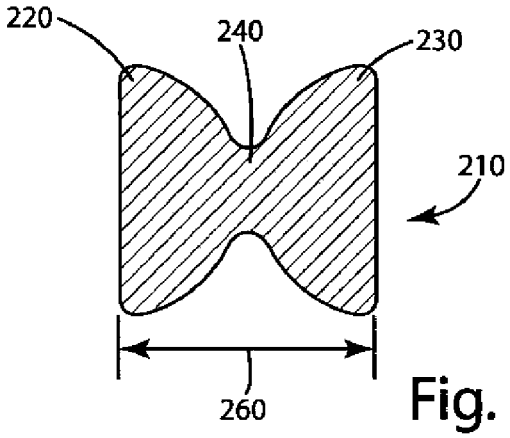
FIG. 10 is a cross section view of the speed nock of the first alternative embodiment taken along line 10-10 in FIG. 9.
Figure 11:
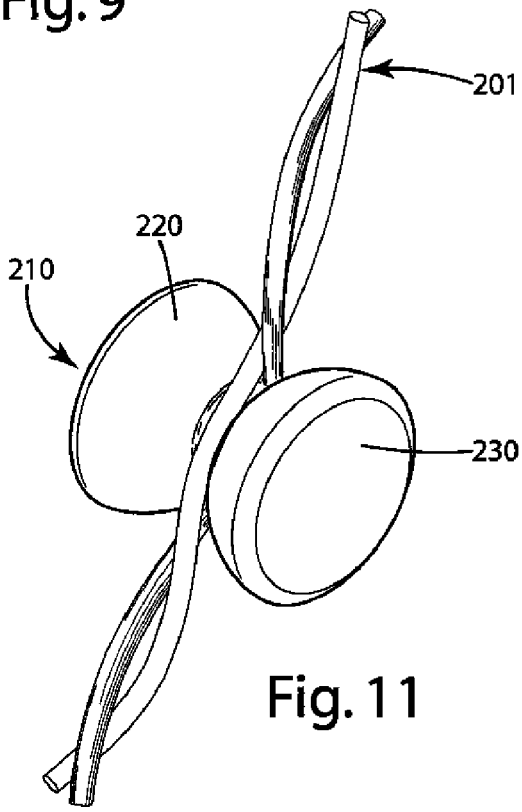
FIG. 11 is a close up view of the speed nock of the first alternative embodiment installed on the bowstring.

A first alternative embodiment of the speed nock is shown in FIGS. 7-11 and generally designated 210. This speed nock is similar to the above described speed nock with several exceptions. For example, this embodiment can include the "U" shaped reduced dimension section or central portion 240 symmetric about the longitudinal axis 250 and the micro finish in the area designated as 247. The greater masses, as in the above embodiment 10, can be located near to the ends of the speed nock. However, in this embodiment 20 the shape of the enlarged portions 220, 230 can be of a truncated sphere wherein the weight can be controlled by varying the dimension 260 (FIG. 10). The speed nock of this embodiment can also be inserted in and retained on the bowstring between strands or groups of strands as shown in FIG. 11.

Figure 12:
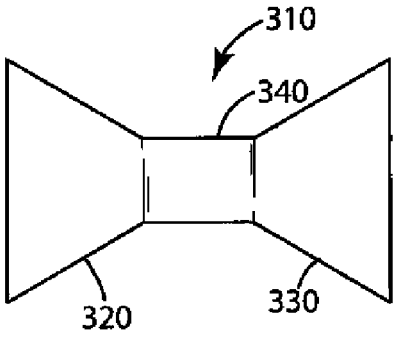
FIG. 12 is a side view of a second alternative embodiment of the speed nock.
Figure 13:
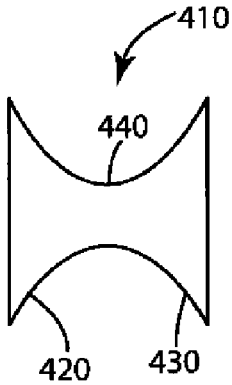
FIG. 13 is a side view of a third alternative embodiment of the speed nock.
Figure 14:
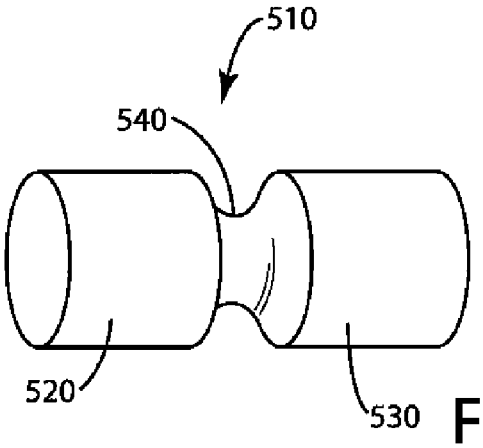
FIG. 14 is a side view of a fourth alternative embodiment of the speed nock.

Other alternative embodiments of the speed nock are shown in FIGS. 12-14 and generally designated 310, 410 and 510. These speed nocks are similar to the above described speed nocks with several exceptions. For example, these embodiments utilize other suitable geometric configurations of the speed nock. As shown in FIG. 12, the enlarged portions 320, 330 are cones connected with a bar shaped central portion 340. As shown in FIG. 13, the enlarged portions 420, 430 and central portion 440 generally form a pulley shaped construction. In FIG. 14, the speed nock 510 includes cylindrical enlarged portions 520, 530 joined with the central portion 540.

Figure 15:
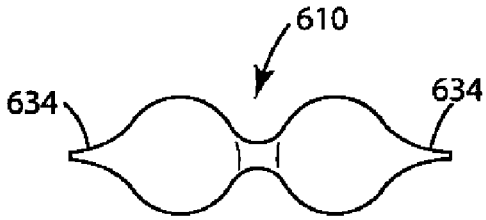
FIG. 15 is a side view of a fifth alternative embodiment of the speed nock.
Figure 16:
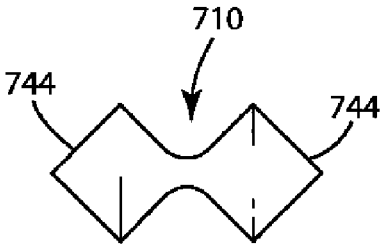
FIG. 16 is a side view of a sixth alternative embodiment of the speed nock.

Even more alternative embodiments of the speed nock are shown in FIGS. 15 and 16 and generally designated 610 and 710. These speed nocks are similar to the above described speed nocks with several exceptions. For example, these embodiments can include integral projections 634 and 744. These projections can be shaped and sized to facilitate insertion of the speed nocks through or between adjacent bowstring strands. For example, ends 634 and 744 can separate bowstring strands or groups of strands, and in some cases, obviate the need to use a separate strand separator tool when installing the speed nocks on a bowstring.

Figure 17:
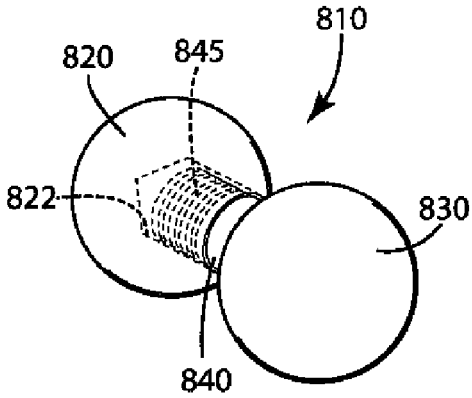
FIG. 17 is a side view of a seventh alternative embodiment of the speed nock.

Yet another alternative embodiment of the speed nock is shown in FIG. 17 and generally designated 810. This speed nock is similar to the above described speed nock with several exceptions. For example, the speed nock 10 is a two-piece speed nock. One enlarged portion 830 includes a threaded stud 840 which functions as a central portion or reduced dimension portion, and that threads into an aperture 822 in the other enlarged portion 820. When threaded into the other enlarged portion, the stud can connect and form a transition between the enlarged portions. Optionally, the end of the stud 840 can be pointed to facilitate insertion through bowstring strands as desired. After the stud is inserted through the strands, the other enlarged portion 820 can be threaded onto the stud to secure the speed nock to the bowstring.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The invention claimed is:

1. A method comprising:

providing a speed nock including, a longitudinal axis opposing first and second ends, the opposing first and second ends including at least partially spherical elements aligned with the longitudinal axis passing approximately through centers of the at least partially spherical elements and a reduced dimension central portion positioned between the at least partially spherical elements and aligned along the longitudinal axis so that the speed nock forms at least one of a three-dimensional hourglass shape and a three dimensional dumbbell shape;

joining the speed nock with a bowstring of an archery bow between a first and a second limb of the archery bow, wherein the reduced dimension central portion is positioned between a first strand and a second strand of the bowstring so that the first strand and the second strand engage the reduced dimension central portion.

2. The method of claim 1 wherein the reduced dimension central portion includes at least one of a coating, a polished surface and a micro-finish that at least reduces wear on the first and second strands by the speed nock.

3. The method of claim 1 wherein the speed nock is of a three-dimensional hourglass shape.

4. The method of claim 1 wherein the speed nock is of a three dimensional dumbbell shape.

5. The method of claim 1 wherein the first and second ends are each in the form of generally truncated spheres.

6. The method of claim 1 wherein the reduced dimension central portion includes a first maximum cross section taken perpendicular to the longitudinal axis, wherein the first end includes a second maximum cross section taken perpendicular to the longitudinal axis, wherein the second maximum cross section is greater than the first maximum cross section.

7. The method of claim 1 wherein the speed nock is constructed from at least one of a metal, a composite material, and a polymer.

8. The method of claim 1 comprising sliding the speed nock along the bowstring between the first and second strands of the bowstring.

9. An archery apparatus comprising:

a bowstring including a plurality of strands;

a speed nock including:

a longitudinal axis including a first end, a second end opposite the first end, and a central region located between the first and the second end;

a first enlarged portion joined with the first end, the first enlarged portion including a first maximum dimension taken generally perpendicular to the longitudinal axis, a second enlarged portion joined with the second end, opposite the first end, the second enlarged portion including a second maximum dimension taken generally perpendicular to the longitudinal axis; and a central portion located between the opposing first and second ends, the central portion being aligned with the longitudinal axis, the central portion including a third maximum dimension, the central portion connecting the first enlarged portion and the second enlarged portion, wherein the third maximum dimension is smaller than the first maximum dimension of the first enlarged portion, and smaller than the second maximum dimension of the second enlarged portion, wherein the central portion is positioned between at least two of the plurality of strands of the bowstring, wherein the at least two of the plurality of strands pinch the central portion of the speed nock to at least assist in holding the speed nock in a selected location along the bowstring, wherein the first and second enlarged portions are positioned adjacent the bowstring, with the central portion of the speed nock passing at least partially through the bowstring, wherein the longitudinal axis is oriented transverse to the bowstring.

10. The archery apparatus of claim 9 wherein the first enlarged portion and the second enlarged portion are generally in the form of truncated spheres.

11. The archery apparatus of claim 9 wherein the first enlarged portion and the second enlarged portion are generally in the form of spheres that are connected by the central portion.

12. The archery apparatus of claim 9 wherein the first enlarged portion, the second enlarged portion and the central portion form at least one of an hourglass and a dumbbell shape.

13. The archery apparatus of claim 9 wherein the central portion includes at least one of a coating, a polished surface and a micro-finish that at least reduces abrasion of the strands.

14. The archery apparatus of claim 9 wherein the second enlarged portion and the first enlarged portion are generally symmetric in shape to one another about the central region of the longitudinal axis.

15. The archery apparatus of claim 9 wherein the first enlarged portion and the second enlarged portion are generally in the form of at least one of opposing cones and opposing cylinders.

16. The archery apparatus of claim 9 wherein the central portion is slidable between the at least two of the plurality of strands whereby the speed nock can move along the bowstring to different locations, and wherein the speed nock is constructed from metal.

17. A method for increasing the speed of an arrow shot from an archery bow having a riser, first and second limbs joined with the riser, and a bowstring strung at least partially between the limbs, the bowstring including a plurality of strands, the method comprising:

providing a speed nock including a first enlarged portion and a second enlarged portion connected via a central portion, the central portion having a maximum cross section being smaller than maximum cross sections of either of the first and second enlarged portions;

inserting the first enlarged portion between and past at least two of the plurality of strands of the bowstring; and positioning the central portion between the at least two of the plurality of strands of the bowstring so that the at least two of the plurality of strands pinch the central portion of the speed nock to at least assist in holding the speed nock in a selected location along the bowstring; and sliding the speed nock along the bowstring so that the central portion moves between the at least two of the plurality of strands.

18. The method of claim 17 comprising shooting arrows with the bow multiple times and iteratively sliding the speed nock along the bowstring between the at least two of the plurality of strands.

19. The method of claim 17 wherein the speed nock is in the form of a three dimensional hour glass.

20. The method of claim 17 wherein the speed nock is in the form of a three dimensional dumbbell.

* * * * *